US010398930B2

(12) United States Patent
Chessen et al.

(10) Patent No.: US 10,398,930 B2
(45) Date of Patent: Sep. 3, 2019

(54) STRENGTH AND EXERCISE APPARATUS

(71) Applicants: Eric Chessen, Little Neck, NY (US); Ryan J. Pitts, Jamaica, NY (US)

(72) Inventors: Eric Chessen, Little Neck, NY (US); Ryan J. Pitts, Jamaica, NY (US)

( * ) Notice: Subject to any disclaimer, the term of this patent is extended or adjusted under 35 U.S.C. 154(b) by 0 days.

(21) Appl. No.: 15/354,541

(22) Filed: Nov. 17, 2016

(65) Prior Publication Data

US 2017/0136285 A1 May 18, 2017

Related U.S. Application Data

(60) Provisional application No. 62/256,178, filed on Nov. 17, 2015.

(51) Int. Cl.

| | |
|---|---|
| ***A63B 21/00*** | (2006.01) |
| ***A63B 21/055*** | (2006.01) |
| ***A63B 23/035*** | (2006.01) |
| ***A63B 23/04*** | (2006.01) |
| ***A63B 21/06*** | (2006.01) |
| ***A63B 23/12*** | (2006.01) |

(52) U.S. Cl.

CPC .... *A63B 21/4035* (2015.10); *A63B 21/00065* (2013.01); *A63B 21/0552* (2013.01); *A63B 21/0618* (2013.01); *A63B 23/03525* (2013.01); *A63B 23/047* (2013.01); *A63B 23/1209* (2013.01); *A63B 21/151* (2013.01); *A63B 21/4001* (2015.10); *A63B 23/03508* (2013.01); *A63B 23/03541* (2013.01)

(58) Field of Classification Search

CPC ..... A63B 21/00065; A63B 21/0004; A63B 21/06; A63B 21/0552; A63B 21/151; A63B 21/4035; A63B 23/047; A63B 23/03525; A63B 23/03541; A63B 23/03508

See application file for complete search history.

(56) References Cited

U.S. PATENT DOCUMENTS

| | | | | |
|---|---|---|---|---|
| 5,540,640 | A * | 7/1996 | Povilaitis | A63B 21/072 482/106 |
| 7,416,412 | B2 * | 8/2008 | Segrest | G09B 19/00 434/226 |
| D606,611 | S * | 12/2009 | Rogers | D21/698 |
| 7,972,224 | B2 * | 7/2011 | Gilman | A63B 21/06 473/441 |
| 8,986,172 | B2 * | 3/2015 | Poole | A63B 21/0552 473/441 |
| 9,186,538 | B1 | 11/2015 | Seen et al. | |

(Continued)

FOREIGN PATENT DOCUMENTS

| | | |
|---|---|---|
| GB | 2507081 A | 4/2014 |
| JP | 5238918 B2 | 4/2013 |

*Primary Examiner* — Megan Anderson

(74) *Attorney, Agent, or Firm* — Gearhart Law LLC

(57) ABSTRACT

A mobile exercise apparatus performing physical exercises including lifting, pushing, and pulling is provided. The apparatus includes an exercise device having a planar elongated frame. The apparatus further includes a weight receiving portion configured to house one or more weights, a handle portion configured to enable a user to lift the exercise device while maintaining the position of the one or more weights, and a pulling portion configured to securing a pulling aid, wherein the elongated frame is bent at a curved portion at approximately a 90 degree angle.

14 Claims, 5 Drawing Sheets

(56) References Cited

U.S. PATENT DOCUMENTS

| | | | | |
|---|---|---|---|---|
| 9,504,866 | B2 * | 11/2016 | Peralo | A63B 21/4035 |
| 2009/0051131 | A1 * | 2/2009 | Warrington | A45F 3/14 280/19 |
| 2011/0224051 | A1 * | 9/2011 | Larish | A63B 21/012 482/93 |
| 2013/0324371 | A1 | 12/2013 | Cayo | |
| 2014/0106942 | A1 | 4/2014 | Abelbeck | |

* cited by examiner

STRENGTH AND EXERCISE APPARATUS

CLAIM OF PRIORITY

This utility patent application claims priority to U.S. Provisional Application No. 62/256,178, filed on Nov. 17, 2015. The contents of this application are hereby incorporated by reference.

FIELD OF THE EMBODIMENTS

This invention relates to exercise equipment and, in particular, to exercise equipment designed to enable a user to lift, push, and pull one or more weighted objects.

BACKGROUND OF THE EMBODIMENTS

Effective exercising requires a multitude of various physical techniques. This is evident by the vast amount of exercise equipment out on the market. These pieces of exercise equipment are often designed specifically for one type of exercise and can often be found in gyms.

Many pieces of exercise equipment serve only one purpose such as, e.g., weighted carries or dragging, and can take up undue space. Other pieces of equipment enable a user to perform a large variety of exercise techniques, but are stationary and also take up undue space. There is a need for a mobile piece of exercise equipment that serves a plurality of purposes.

Examples of related art are described below:

U.S. Pat. No. 7,695,411 relates to a multimotion exercise bicycle capable of providing a cardiovascular exercise simultaneously with an upper body weight training exercise. The cardiovascular exercise is accomplished by a pedaling movement connected to a resistance means. The upper body exercise is accomplished by a pushing or a pulling movement of a handlebar and arm setup connected to a disk which is further connected to a cable attached to a weight bearing platform. The weight of the user provides the resistance for the upper body movement. The difficulty level of the upper body movement is adjustable by changing the location of the handlebars relative to the disk and by changing where the cable attaches to the disk. As the user performs these exercises simultaneously, the invention allows the user to burn more calories and reduce work-out time in half.

U.S. Pat. No. 9,114,299 relates to an apparatus for muscle conditioning comprising a supporting body, a hood-shaped pad, moveable relative to the body, and resistive means in the form of a weight stack and suspension mechanism. The weight stack is coupled to the hood-shaped pad via the suspension mechanism, such that a resistive force can be applied against movement of the hood-shaped pad from a first position relative to the body to a second position relative to the body. The apparatus enables the conditioning of the muscles required for successful rugby scrummaging.

U.S. Pat. No. 9,186,538 relates to an exercise apparatus for wearing about an upper portion of a user's body and for securing weights having a centrally-located hole extending therethrough to the body. The apparatus generally includes a frame backpack and an exercise sled to which one or more weights may be attached. The exercise sled is removably mounted to the frame backpack to operate in a first mode of operation and may be used separately from the frame backpack in a second mode of operation. In certain embodiments, the apparatus may include a connection strap for connecting the exercise sled to the frame backpack in the second mode of operation such that a user may pull the exercise sled while wearing the frame backpack.

US Patent Application No. 2013/0324371 relates to a sled with tubular runners that have a square aft cross section from which fixable bayonet couplings having three sides of a square extend and can receive a pole support frame's side members which cover the bayonet extensions. The pole support frame supports opposed bearings that rotationally mount a pole axle from which an equipment support pole transversely extends. Two semi-circumferential arrays of holes interact with holes in a fixed angular adjuster, mounted to the pole support frame, to enable multiple discrete fixed angular positions for the pole. The sled can support weights, preferably in the form of containers of water, as well as exercise equipment. The pole can support pole extensions, exercise equipment, and pulleys for guiding cables that connect weight containers to exercise apparatus.

US Patent Application No. 2014/0106942 relates to an exercise device with a frame which may include a longitudinal center section, defining a first end and a second end, and two substantially equal end sections, one of each of the end sections may be coupled to the first end and the second end of the center section substantially at a midpoint with respect to the width and the height of the end sections. One or more pins may be coupled to the frame between the first end and the second end, the pins adapted to receive weight plates. A bumper may be coupled to the top and bottom of the end sections. A sled frame may be added to the device to convert the device to a functional sled with different configurations. The sled skids may be removable to be easily repositioned, removed or replaced when worn.

UK Patent Application No. GB2507081 relates to a muscle training system that includes a sled arranged to receive weights, weights, and a means of attachment of the sled to a user, such as a backpack harness. The sled may comprise a pair of runners mounted on a base, a mesh for containing components held in the base and a foldable ballast weight pole for fixing the weights in use. The system may comprise walking poles to aid the user pulling the sled. The amount of weight placed on the sled may be varied to provide different levels of resistance. The base may further comprise slots to accept resistance straps to enable to sled to be pulled or for exercise to be carried out when the user is stood on the sled, such as beaming. A door stopper or chair wedge may also be provided for attaching resistance straps. The apparatus may be used to recreate Nordic walking.

Japanese Patent Application No. JP 5238918 relates to a lower limb function training device which the patient oneself can use safely with no sense of fear, which is used to prevent or improve a drop foot contracture or to expand the excursion of a joint while preventing the patient from using it over an appropriate amount of exercise to the utmost, which allows the patient to select the type of exercise, and which enables measurement of state of the body. The device is provided with a contact sensor, a foot rest on which the feet of the patient rest and selectively moves back and forth or rocks vertically, a movement counter for counting the back-and-forth movements or vertical rockings of the foot rest, and a brake device for braking the back-and-forth movement or vertical rocking of the foot rest when the count reaches a preset value.

None of the art described above addresses all of the issues that the present invention does.

SUMMARY OF THE EMBODIMENTS

According to an embodiment of the present invention, a mobile exercise apparatus is provided, which includes an exercise device having a planar elongated frame. According to an embodiment, the exercise apparatus includes a weight receiving portion configured to house one or more weights, a handle portion configured to enable a user to lift the exercise device while maintaining the position of the one or more weights, and a pulling portion configured to securing a pulling aid, wherein the elongated frame is bent at a curved portion at approximately a 90 degree angle.

It is an object of the present invention to provide for the apparatus, wherein the apparatus further comprises a pulling aid.

It is an object of the present invention to provide for the apparatus, wherein the pulling aid includes device selected from the group consisting of: a rope; a chain; and a wire.

It is an object of the present invention to provide for the apparatus, wherein the pulling aid is removable from the exercise device.

It is an object of the present invention to provide for the apparatus, wherein the handle portion is further configured to be positioned on the elongated frame at a location that enables the user to push the exercise device across a surface.

It is an object of the present invention to provide for the apparatus, wherein the weight receiving portion includes a locking mechanism for securing the one or more weights.

It is an object of the present invention to provide for the apparatus, wherein the weight receiving portion comprises a cylindrical protrusion extending from the elongated frame.

It is an object of the present invention to provide for the apparatus, wherein the elongated frame includes two or more curved portions.

It is an object of the present invention to provide for the apparatus, further comprising runner skis covering a portion of the elongated frame.

It is an object of the present invention to provide for the apparatus, wherein the planar elongated frame, the weight receiving portion, the handle portion, and the pulling portion are coupled as a single structure.

DESCRIPTION OF THE PREFERRED EMBODIMENTS

Figure 1:
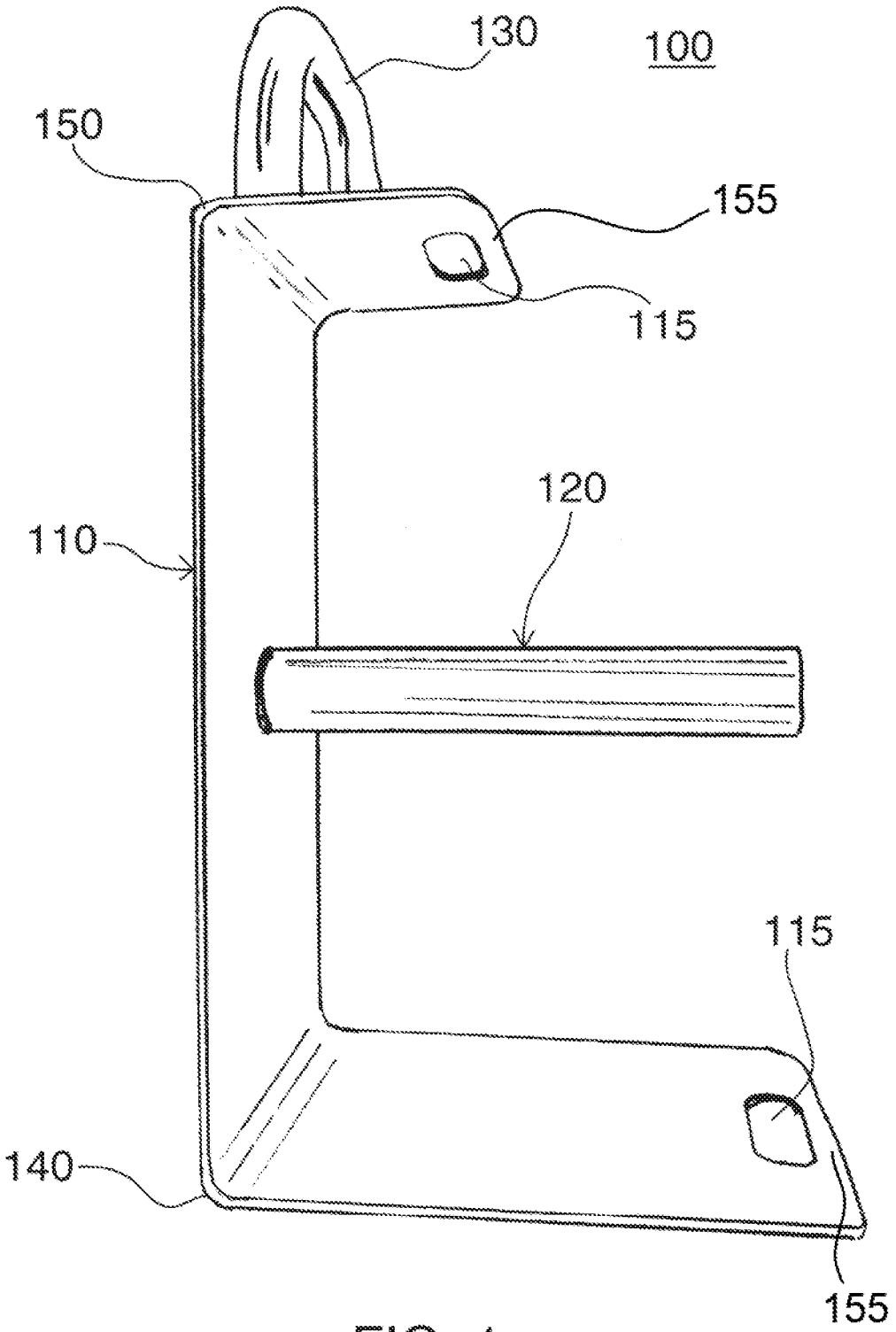
FIG. 1 shows a side view of a mobile exercise apparatus, according to an embodiment of the present invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Figure 2:
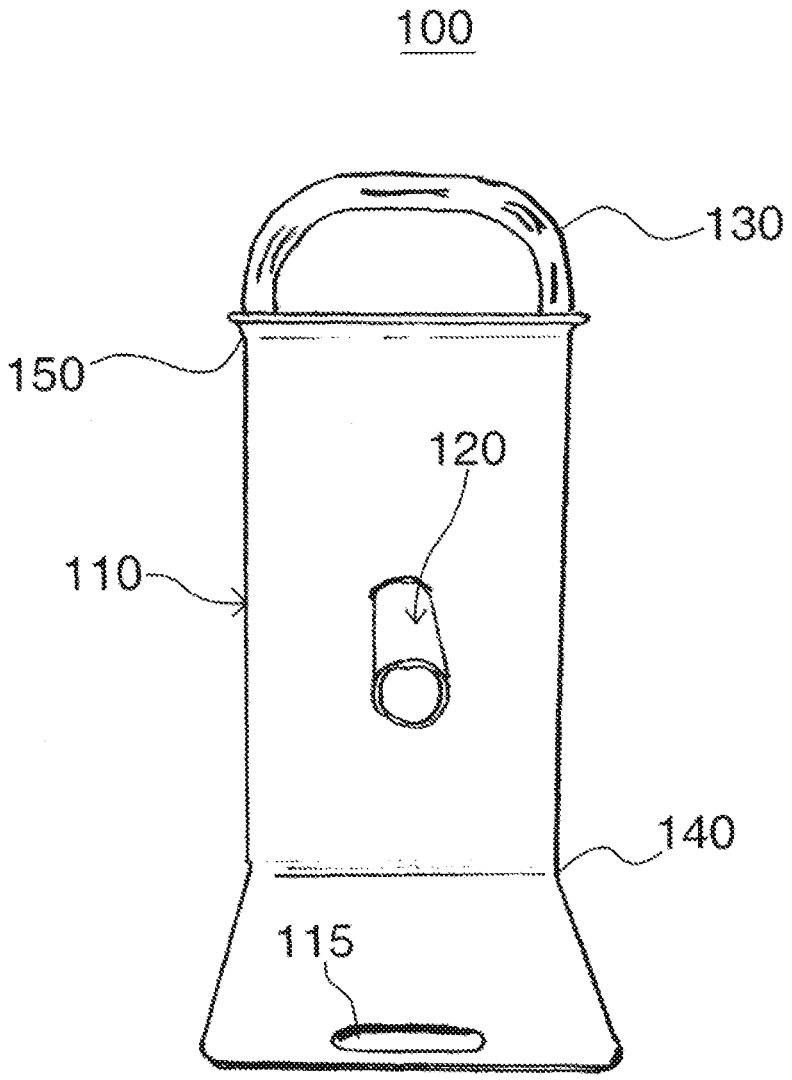
FIG. 2 shows a front view of the mobile exercise apparatus, according to an embodiment of the present invention.
Figure 3:
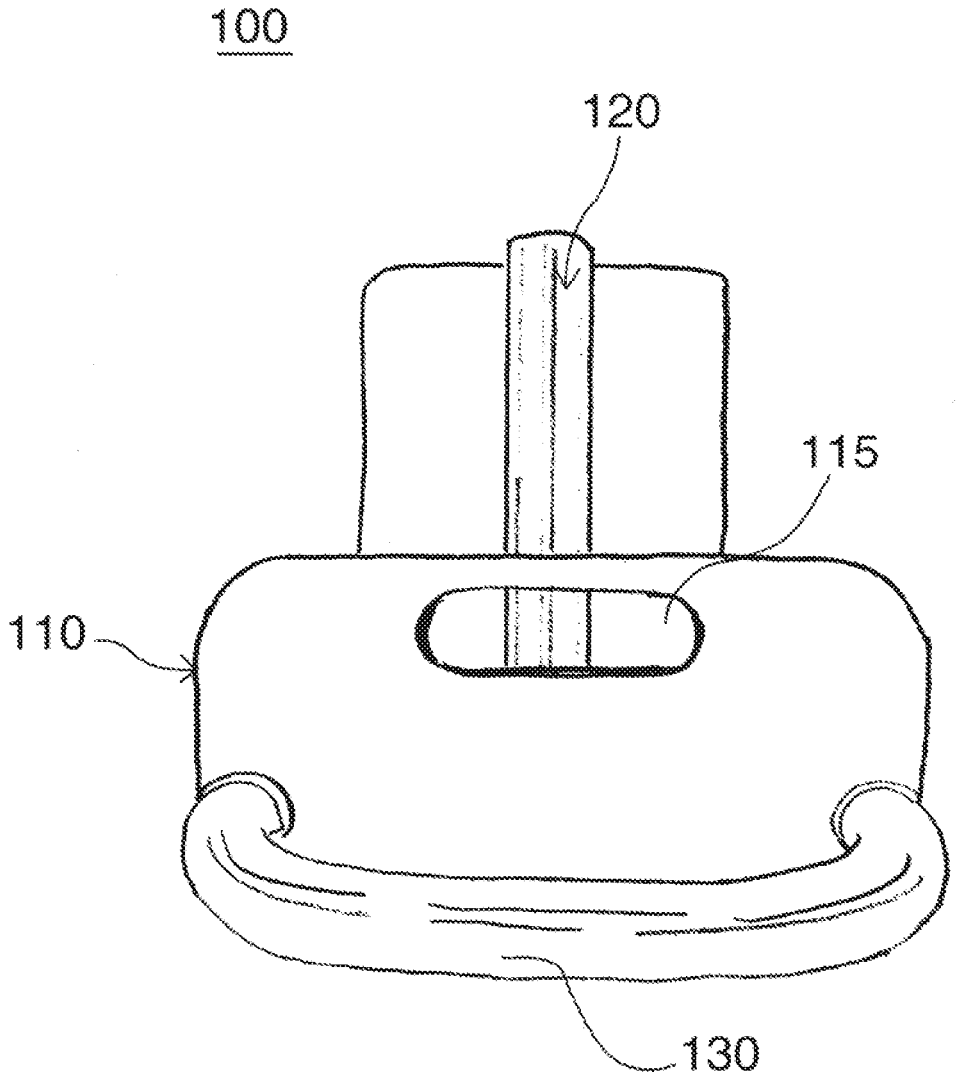
FIG. 3 shows a top view of the mobile exercise apparatus, according to an embodiment of the present principles.

Referring now to FIGS. 1, 2, and 3, a side view (FIG. 1), a front view (FIG. 2), and a top view (FIG. 3) of a mobile exercise apparatus 100 are illustratively depicted, in accordance with an embodiment of the present invention.

The exercise apparatus 100 includes an elongated frame 110, one or more curved portions (140, 150), a handle portion 130, and a weight receiving portion 120. According to an embodiment, the exercise apparatus 100 is mobile and of a size and shape configured to be moved and stored by an individual person.

According to the embodiment shown in FIGS. 1, 2, and 3, the mobile exercise apparatus 100 includes an elongated frame 110 having a plurality of curved portions 140, 150. According to an embodiment, the mobile exercise apparatus 100 may include only one curved portion. According to another embodiment, the mobile exercise apparatus 100 may include more than two curved portions.

According to an embodiment, the elongated frame 110 further includes at least one opening 115. These openings 115 may be configured to enable a user to grip the apparatus 100 for pulling, pushing, and/or lifting. According to an embodiment, these openings 115 further form secondary handles 155 for pulling, pushing, and/or lifting. Therefore, according to an embodiment of the present invention, these openings 115 may be referred to as pulling portions. A pulling aid 160 (shown in FIG. 5) may also be secured to the elongated frame 110 through one or more of the openings 115.

According to an embodiment, the weight receiving portion 120 include a cylindrical protrusion extending from the elongated frame 110. The cylindrical protrusion is designed such that one or more weights can be placed over the cylindrical protrusion. It is noted, however, that the weight receiving portion 120 may include a protrusion of another shape suitable for receiving and storing weights, and may also include any other form of weight-securing apparatus, while maintaining the spirit of the present invention. According to an embodiment the protrusion of the weight receiving portion 120 is hollow. According to another embodiment, the protrusion of the weight receiving portion 120 is solid.

The handle portion 130 is positioned along the elongated frame 110 such that a user may lift the exercise apparatus 100, drag the exercise apparatus 100, and/or pull the exercise apparatus 100, thereby enabling the user to perform a variety of exercise routines.

According to an embodiment, any or all of the elongated frame 110, the weight receiving portion 120, and the handle portion 130 may be removably attached from each other. According to another embodiment, all of the elongated frame 110, the weight receiving portion 120, and the handle portion 130 are coupled together to form a single structure.

According to an embodiment, the exercise apparatus 100 may include one or more of each of the weight receiving portion 120 and weight receiving portion. It is also noted that any of the one or more weight receiving portions 120 and handle portions 130 may be positioned on the elongated frame 110 at a location or locations that enable the user to perform the described functions of the present invention.

According to an embodiment, any or all of the components of the exercise apparatus may include a metal of suitable strength (e.g., steel, etc.), a hard plastic and/or rubber, or any other suitable material.

Figure 4:
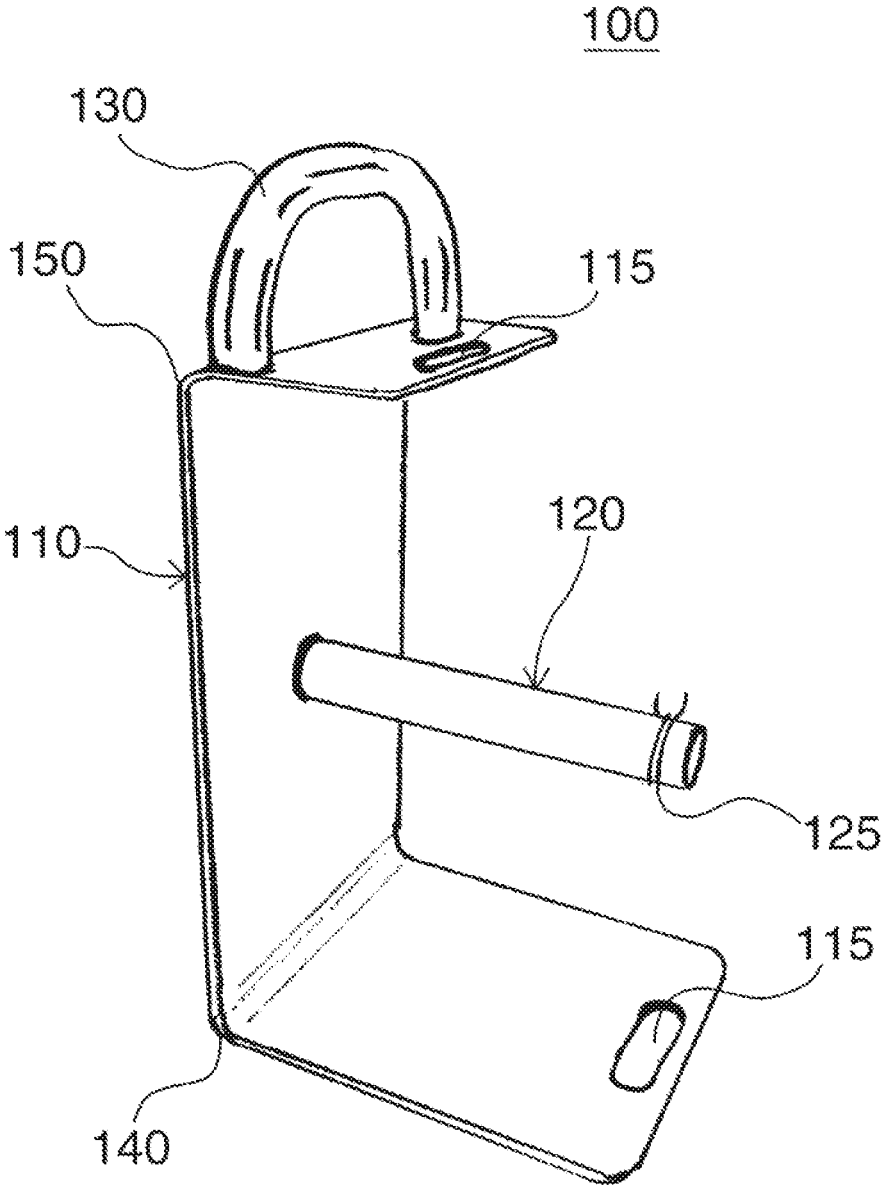
FIG. 4 shows a perspective view of the mobile exercise apparatus having a weight locking mechanism, according to an embodiment of the present invention.

Referring now to FIG. 4, a perspective view of the mobile exercise apparatus 100 having a weight locking mechanism 125 is illustratively depicted, in accordance with an embodiment of the present invention.

According to an embodiment, the weight receiving portion is configured to house a disc-shaped weight, wherein the disc-shaped weight is positioned over the cylindrical protrusion of the weight receiving portion 120. However, it should be noted that any appropriate combination of weight shape and weight receiving portion 120 may be used while maintaining the spirit of the present invention.

According to an embodiment, the weight receiving portion 120 includes a locking mechanism 125 for securing the weights on the weight receiving portion 120. The locking mechanism 125 may be, as shown in FIG. 4, a weight clamp. Once one or more weights are positioned on the weight receiving portion 120, the locking mechanism 125 secures the one or more weights in place and/or from being removed from the weight receiving portion. This decreases the risk of harm to the user or to a bystander from falling weights.

Figure 5:
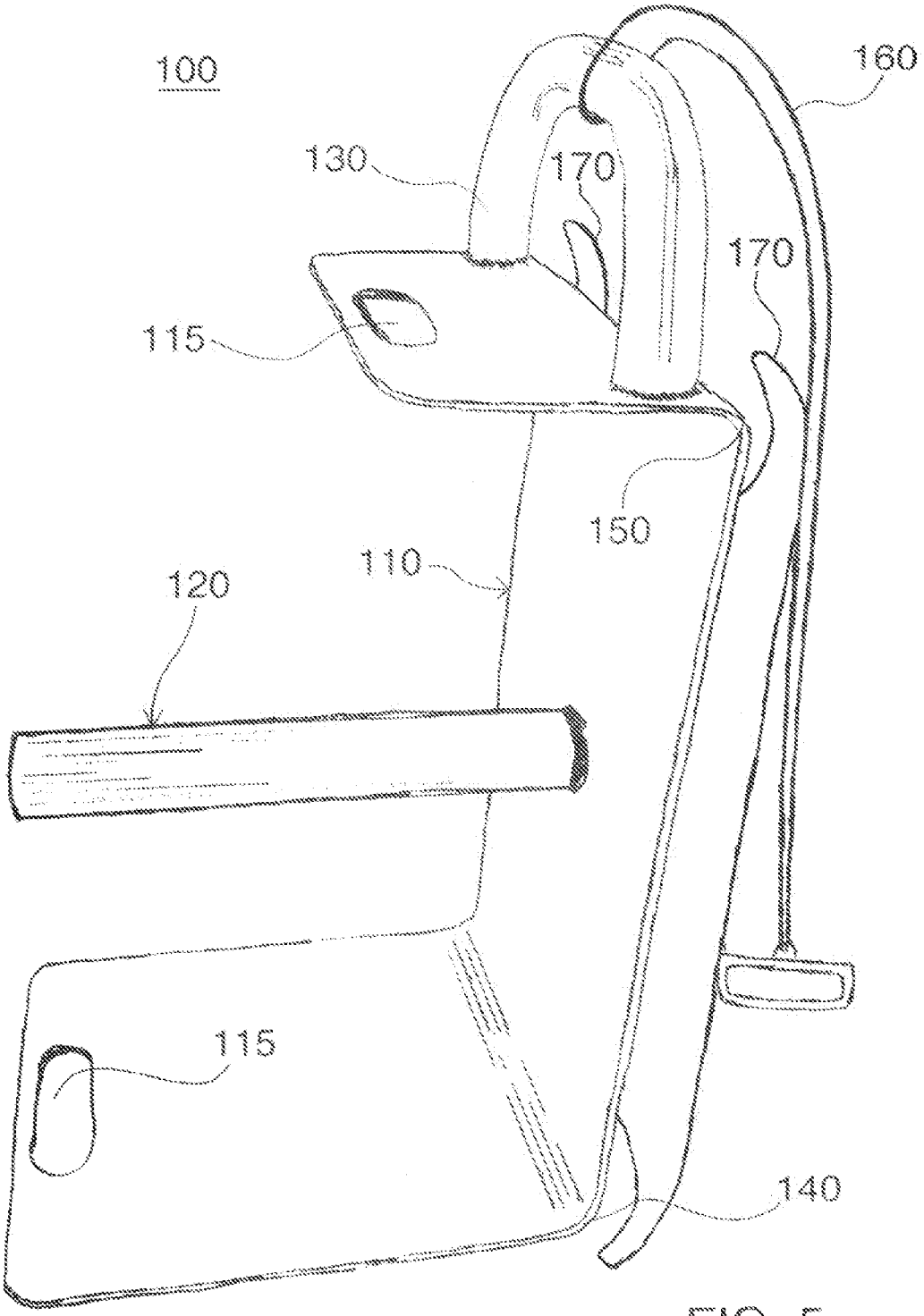
FIG. 5 shows a perspective view of the mobile exercise apparatus having a pulling aid, according to an embodiment of the present invention.

Referring now to FIG. 5, a perspective view of the mobile exercise apparatus 100 having a pulling aid 160 is illustratively depicted, in accordance with an embodiment of the present invention.

According to the embodiment shown in FIG. 5, the mobile exercise apparatus 100 is shown having a pulling aid 160 coupled to the handle portion 130. However, the pulling aid may be coupled to other portions of the apparatus 100, such as, e.g., the one or more openings 115. According to an embodiment, the pulling aid may be coupled to the apparatus 100 via a knot, a clip, and/or any other suitable method.

According to an embodiment, the pulling aid 160 is positioned on the exercise apparatus 100 at a location suitable to enable a user to pull the exercise apparatus 100 along a surface.

After a weight is secured on the weight receiving portion 120, a user has the ability to lift the exercise apparatus 100, push the exercise apparatus 100, and/or pull the exercise apparatus 100. It is noted that the pulling aid 160 may include any suitable material or a combination of materials including, but not limited to, ropes, chains, cords, strings, wires, etc.

According to an embodiment, one or more runner skis 170 may be attached to the elongated frame 110. These skis may aid in the dragging and/or pushing of the apparatus 100.

The many elements of the present invention make it unique in the field. The novelty is illustrated by the various options for nearly every aspect of the invention that allow it to be used in the proper exercise form by a variety of users, both in terms of body size and fitness level. Additionally, there is a wide range of exercises available to any user of the present invention, and users can perform exercises that use the upper and lower extremity muscle groups simultaneously.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A mobile exercise apparatus, comprising:

an exercise device having a planar elongated frame, including:

a weight receiving portion configured to house one or more weights at a fixed vertical angle, wherein the weight receiving portion and the planar elongated frame form a single structure;

a handle portion configured to enable a user to lift the exercise device, by the handle portion, while maintaining the fixed vertical angle of the one or more weights;

one or more secondary handle portions, wherein the one or more secondary handle portions are configured to enable the user to push the mobile exercise apparatus across a surface; and a pulling portion configured to secure a pulling aid, wherein the planar elongated frame is bent at a first curved portion at a 90 degree angle.

2. The mobile exercise apparatus as recited in claim 1, further comprising the pulling aid.

3. The mobile exercise apparatus as recited in claim 2, wherein the pulling aid includes a device selected from the group consisting of: a rope; a chain; and a wire.

4. The mobile exercise apparatus as recited in claim 2, wherein the pulling aid is removable from the exercise device.

5. The mobile exercise apparatus as recited in claim 1, wherein the weight receiving portion includes a locking mechanism for securing the one or more weights.

6. The mobile exercise apparatus as recited in claim 5, wherein the locking mechanism is removable from the weight receiving portion.

7. The mobile exercise apparatus as recited in claim 1, wherein the planar elongated frame, the weight receiving portion, the handle portion, and the pulling portion are coupled as a single structure.

8. The mobile exercise apparatus as recited in claim 7, wherein the single structure is a single metal structure.

9. The mobile exercise apparatus as recited in claim 1, wherein the handle portion is positioned at an end of the planar elongated frame.

10. The mobile exercise apparatus as recited in claim 1, wherein the weight receiving portion comprises a cylindrical protrusion extending from the planar elongated frame.

11. The mobile exercise apparatus as recited in claim 1, wherein the handle portion and the weight receiving portion are positioned on opposite sides of the first curved portion.

12. The mobile exercise apparatus as recited in claim 1, wherein both the handle portion and the weight receiving portion are positioned on one side of the first curved portion.

13. The mobile exercise apparatus as recited in claim 1, wherein the handle portion is removable from the planar elongated frame.

14. The mobile exercise apparatus as recited in claim 1, further comprising runner skis covering a portion of the planar elongated frame.

* * * * *